US011039729B2

(12) United States Patent
Lee et al.

(10) Patent No.: US 11,039,729 B2
(45) Date of Patent: Jun. 22, 2021

(54) DISHWASHER

(71) Applicant: LG Electronics Inc., Seoul (KR)

(72) Inventors: Sangik Lee, Seoul (KR); Yongjin Choi, Seoul (KR); Jaechul Lee, Seoul (KR); Shinwoo Han, Seoul (KR)

(73) Assignee: LG Electronics Inc., Seoul (KR)

( * ) Notice: Subject to any disclaimer, the term of this patent is extended or adjusted under 35 U.S.C. 154(b) by 100 days.

(21) Appl. No.: 16/323,210

(22) PCT Filed: Aug. 3, 2017

(86) PCT No.: PCT/KR2017/008420
§ 371 (c)(1),
(2) Date: Feb. 4, 2019

(87) PCT Pub. No.: WO2018/026225
PCT Pub. Date: Feb. 8, 2018

(65) Prior Publication Data

US 2019/0167067 A1 Jun. 6, 2019

(30) Foreign Application Priority Data

Aug. 4, 2016 (KR) ..... 10-2016-0099558

(51) Int. Cl.
*A47L 15/42* (2006.01)
*B05B 1/00* (2006.01)
*A47L 15/10* (2006.01)

(52) U.S. Cl.
CPC ..... *A47L 15/4223* (2013.01); *A47L 15/10* (2013.01); *A47L 15/42* (2013.01); *A47L 15/4217* (2013.01); *A47L 15/4225* (2013.01); *B05B 1/002* (2018.08)

(58) Field of Classification Search
None
See application file for complete search history.

(56) References Cited

U.S. PATENT DOCUMENTS

2008/0250823 A1* 10/2008 Oak ..... D06F 35/002 68/50
2010/0300499 A1 12/2010 Han et al.

FOREIGN PATENT DOCUMENTS

JP 2008086868 4/2008
JP 2008119151 5/2008
JP 5794338 10/2015
(Continued)

OTHER PUBLICATIONS

Espacenet translation JP2008119151, Dishwasher, 2008 (Year: 2008).*
(Continued)

*Primary Examiner* — Cristi J Tate-Sims
(74) *Attorney, Agent, or Firm* — Fish & Richardson P.C.

(57) ABSTRACT

The dishwasher of the present invention includes: a tub in which a dish washing space is formed; a sump which contains washing water supplied into the tub; a spray module which sprays washing water toward dishes; a pump which supplies the washing water stored in the sump to the spray module; an air jet generator which receives a part of the washing water discharged from the pump to form an air bubble in the washing water; and a discharge module which discharges the washing water containing the air bubble discharged from the air jet generator to a side surface of the tub.

19 Claims, 15 Drawing Sheets

(56) References Cited

FOREIGN PATENT DOCUMENTS

| | | |
|---|---|---|
| KR | 19990054172 | 7/1999 |
| KR | 200305388 | 2/2003 |

OTHER PUBLICATIONS

KIPO translation 10-1997-0073960, Ultrasonic type spirit church of the washing water, 1999 (Year: 1999).*
Espacenet transtion JP2008086868, Microbubble Generator, 2008 (Year: 2008).*

* cited by examiner

DISHWASHER

CROSS-REFERENCE TO RELATED APPLICATIONS

This application is a National Stage application under 35 U.S.C. § 371 of International Application No. PCT/KR2017/008420, filed on Aug. 3, 2017, which claims the benefit of Korean Application No. 10-2016-0099558, filed on Aug. 4, 2016. The disclosures of the prior applications are incorporated by reference in their entirety.

TECHNICAL FIELD

The present invention relates to a dishwasher, and more particularly, to a dishwasher including an air jet generator for generating an air bubble therein.

BACKGROUND ART

A dishwasher is a household appliance that removes foreign matter remaining on a cleaning target object by spraying washing water on the cleaning target object. The dishwasher sprays washing water to the cleaning target object accommodated in a rack according to a cleaning course selected by a user to remove the dirt from the cleaning target object.

As a method for effectively removing foreign matter adhered to the dishes, a method of using a detergent having a strong cleaning ability, a method of increasing the spraying pressure of the washing water can be utilized, or a method of containing an air bubble in the washing water may be utilized.

The washing water containing the air bubble generates free radicals having excellent sterilizing power and chemical decomposing ability while the air bubble is dissipated, thereby effectively removing foreign matter adhered to the dishes.

However, in the air bubble, as the size of the bubble becomes smaller, the total interfacial area becomes larger, the surfacing speed becomes slower, and internal pressure becomes larger, thereby having an excellent adsorption of hydrophobic molecule, and increasing the availability of gas.

In the process of washing the dishes, since the foreign matter adhered to the dishes falls down to the bottom surface of the tub, the bottom surface of the tub can be easily contaminated by the fallen foreign matter.

The washing water flowing in the dishwasher is supplied from the sump to a spray nozzle and is sprayed to the dishes. Therefore, the washing water having the air bubbles should flow to the sump. When the washing water having the air bubbles is introduced into the sump through the bottom surface of the tub, the bottom surface of the tub may be cleaned together with the dishes. In addition, when the washing water falls to the bottom surface of the tub, the pressure of the falling washing water is added. Thus, the bottom surface of the tub can be effectively cleaned.

DISCLOSURE

Technical Problem

It is an object of the present invention to provide a dishwasher which cleans tableware with washing water containing air bubbles while removing contamination on the bottom surface of a tub.

It is an object of the present invention to provide a dishwasher which can perform chemical washing on the bottom surface of a tub with washing water containing air bubbles while performing mechanical washing with washing water falling from a certain height.

It is an object of the present invention to provide a dishwasher which can supply washing water containing air bubbles into a tub by utilizing a structure disposed in the outer surface of the tub.

It is an object of the present invention to provide a dishwasher which forms air bubbles in washing water by sucking outside air without a separate apparatus for injecting air.

It is an object of the present invention to provide a dishwasher which forms air bubbles in washing water by using a conventional pump for dishwashing without a separate pump for supplying washing water to an air jet generator for forming air bubbles.

The object of the present invention is to provide a dishwasher which forms air bubbles of minute size by crushing the air bubbles formed in the washing water to the utmost.

The problems of the present invention are not limited to the above-mentioned problems, and other problems not mentioned can be clearly understood by those skilled in the art from the following description.

Technical Solution

In an aspect, there is provided a dishwasher, including: a tub in which a dish washing space is formed; a sump which contains washing water supplied into the tub; a spray module which sprays washing water toward dishes; a pump which supplies the washing water stored in the sump to the spray module; an air jet generator which receives a part of the washing water discharged from the pump to form an air bubble in the washing water; and a discharge module which discharges the washing water containing the air bubble discharged from the air jet generator to a side surface of the tub, thereby cleaning the bottom surface of the tub by supplying washing water containing air bubbles to the side surface of the tub.

A side surface hole for discharging the washing water introduced into the discharge module into the tub is formed on a side surface of the tub, and the side surface hole is formed at a height of being equal to or less than half a full height of the tub, thereby minimizing the amount of washing water flowing along the side surface.

The discharge module includes: a main discharge pipe to which the washing water discharged from the air jet generator is introduced; a tub discharge pipe which is connected to the main discharge pipe and connected to the tub; and a sealer which seals a space between the main discharge pipe and the tub discharge pipe, thereby stably supplying the washing water containing the air bubbles to the side surface of the tub.

The main discharge pipe includes: a first main discharge pipe which is connected to the air jet generator; and a second main discharge pipe which connects the first main discharge pipe and the tub discharge pipe, wherein the first main discharge pipe and the second main discharge pipe are coupled by a fusion method.

The first main discharge pipe forms a first flow path change coupling portion where a flow path cross-section is vertically extended to one side at a portion where the first main discharge pipe is coupled with the second main discharge pipe, the second main discharge pipe forms a second flow path change coupling portion where a flow path cross-section is vertically extended to one side at a portion where the second main discharge pipe is coupled with the first main discharge pipe, and the first flow path change coupling portion is coupled with the second flow path change coupling portion to form a bent flow path in a flow path of the first main discharge pipe.

The dishwasher further includes a side surface structure disposed outside the side surface of the tub, and the side surface structure includes: a tub discharge flow path which is connected to the discharge module and flows washing water; and a discharge port which discharges the washing water flowing in the tub discharge flow path into the tub, thereby supplying the washing water containing the air bubbles to the tub by utilizing the side surface structure disposed outside the tub.

The dishwasher further includes a generator connection port which is disposed at a lower end of the tub discharge flow path and is connected to the discharge module, thereby connecting the discharge module and side surface structure.

The discharge module is configured of a main discharge pipe which connects the air jet generator and the tub discharge flow path.

The main discharge pipe includes a discharge pipe fixing portion which fixes the discharge module to a cabinet that forms an external shape of dishwasher, thereby minimizing the influence of vibration of the air jet generator.

The air jet generator includes: an impeller which applies centrifugal force to the washing water that flows; a decompression portion which decreases a pressure of the washing water that passed through the impeller; an air suction portion which injects air into the decompression portion; a pressing portion which increases pressure so as to crush the air introduced from the air suction portion; and an air tap which has a plurality of holes so as to crush the air contained in washing water that passed through the pressing portion, thereby forming air bubbles of minute size in the washing water.

The details of other embodiments are included in the detailed description and drawings.

Advantageous Effects

According to an air jet generator of a dishwasher of the present invention, there are one or more of the following effects.

First, the dishwasher according to the present invention discharges the washing water containing the air bubbles through the side surface of the tub to flow into the sump through the bottom surface of the tub, which is advantageous in that the washing water containing the air bubbles can clean the dishes while cleaning the bottom surface of the tub.

Secondly, in the dishwasher according to the present invention, the washing water containing the air bubbles is discharged from the side surface of the tub and dropped onto the bottom surface of the tub, so that the bottom surface of the tub is cleaned by the air bubbles and a physical cleaning due to the drop of the washing water is added, which is advantageous in that the bottom of the tub can be effectively cleaned.

Third, the air jet generator of the dishwasher according to the present embodiment branches a part of the washing water supplied from the pump and generates air bubbles in the washing water through a branched flow, which is advantageous in that the air bubbles occur continuously when the pump of the dishwasher is operated for washing dishes.

Fourth, there is an advantage that an air bubble can be generated at a low pressure by using a pump disposed inside a conventional dishwasher without using a separate pump.

Fifth, there is an advantage that some of the flow branched from the pump rotates along the impeller vane, air is sucked and crushed along the air crushing pipe, and the amount of generated air bubbles is maximized while passing through the air tap.

Sixth, there is also an advantage that the washing water that passed through the air jet generator to the side surface of the tub by utilizing the side surface structure such as a water jacket disposed in the side surface of the tub.

The effects of the present invention are not limited to the effects mentioned above, and other effects not mentioned can be clearly understood by those skilled in the art from the description of the claims.

MODE FOR INVENTION

Figure 1:
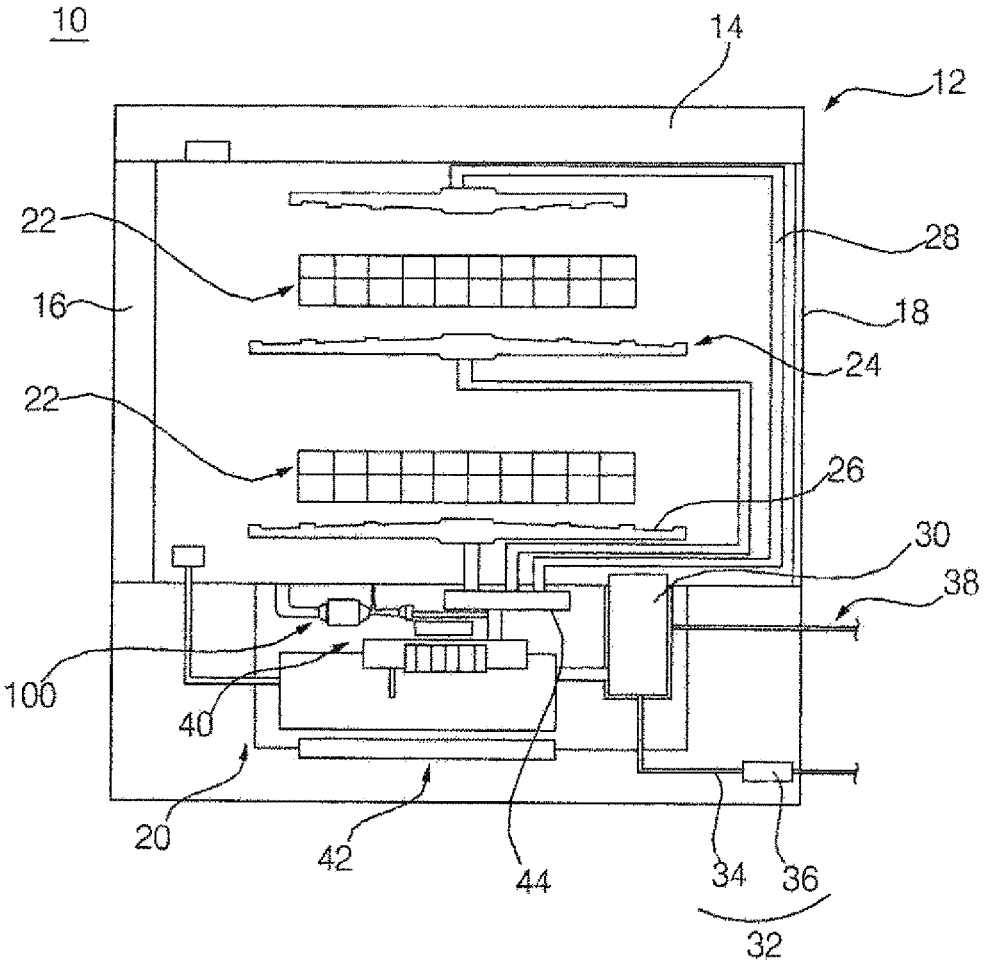
FIG. 1 is a schematic front cross-sectional view of a dishwasher according to an embodiment of the present invention.

Hereinafter, preferred embodiments of the present invention will be described with reference to the accompanying drawings. In describing the present embodiment, the same designations and the same reference numerals are used for the same components, and further description thereof will be omitted.

Hereinafter, an air jet generator of a dishwasher according to embodiments of the present invention will be described with reference to the drawings.

FIG. 1 is a schematic front cross-sectional view of a dishwasher according to an embodiment of the present invention.

Referring to FIG. 1, the dishwasher 10 according to the present embodiment includes a cabinet assembly 12 which forms an outer shape, a rack 22 which is disposed inside the cabinet assembly 12 and on which the dishes are placed, a spray module 24 which is disposed inside the cabinet assembly 12 and sprays washing water toward the dishes, a sump 20 which is disposed inside the cabinet assembly 12 and supplies washing water to the spray module 24, a water supply module 38 which supplies water to the sump 20 or the spray module 24, a drainage module 32 which is connected to the sump 20 and discharges the washing water to the outside, and a filter assembly 30 which is installed in the sump 20 and filters the washing water. In addition, the dishwasher 10 may further include a heater module 42 which is installed in the sump 20 and heats the washing water.

The cabinet assembly 12 forms an outer shape of the dishwasher, and includes a cabinet 14, a door 16 coupled to the cabinet 14 for opening and closing the cabinet 14, and a tub 18 which is installed inside the cabinet 14 and to which washing water or steam is applied, The rack 22 is installed inside the tub 18, and the dishes are placed on the rack 22.

The spray module 24 is implemented to spray washing water toward the dishes. The spray module 24 includes a spray nozzle 26 and a nozzle flow path 28 for supplying washing water to the spray nozzle 26.

A plurality of spray nozzles 26 may be disposed, and a plurality of nozzle flow paths 28 corresponding to the spray nozzle 26 may be disposed. In addition, a nozzle flow path switching portion 44 for selectively supplying washing water to the nozzle flow path 28 may be disposed.

In the present embodiment, the spray module 24 is configured to receive the washing water from the sump 20 storing the washing water and spray the washing water. However, unlike the present embodiment, water may be directly supplied through the water supply module 38.

The water supply module 38 can be configured to receive water from the outside and supply the water to the sump 20, and can be configured to supply water to the sump 20 through the filter assembly 30. In addition, in the dishwasher, the water stored in a water storage portion of a water jacket 400 (see FIG. 12) described below can be supplied to the sump 20.

The discharge module 32 is implemented to discharge the washing water stored in the sump 20 to the outside, and includes a drainage flow path 34 and a drainage pump 36.

The filter assembly 30 is implemented to filter foreign matter such as food waste contained in the washing water, and is disposed in a flow path of the washing water flowing from the tub 18 into the sump 20.

To this end, the sump 20 may be provided with a filter mounting portion where the filter assembly 30 is installed, and a filter flow path connecting the filter mounting portion and the inside of the sump 20 may be disposed.

The sump 20 is provided with a sump storage portion for storing the washing water therein, and further includes a pump 40 for pumping the stored washing water to the spray module 24.

The pump 40 pumps the washing water stored in the sump 20 to the spray module 24. The pump 40 is connected to the spray module 24 through a pump flow path.

The pump 40 according to the present embodiment supplies washing water to the air jet generator 100 in addition to the spray module 24 through a branch pipe 230. The air jet generator 100 is supplied with washing water through a flow path branched from the pump, and sucks gas into the supplied washing water and crushes to generate minute air bubbles. The air jet generator 100 is connected to the tub 18. When the pump is operated, the washing water having the air bubbles generated by the air jet generator 100 is supplied into the sump 20 via the tub 18, and then, the washing water containing the air bubbles supplied to the sump 20 is pumped to the spray module 24, thereby increasing cleaning power by using the washing water containing minute air bubbles so as to wash the dishes.

The sump 20 is connected to a steam flow path and a steam nozzle that spray the steam generated by the heater module 42 into the tub 18. A valve (not shown) for intermitting steam may be installed in the steam flow path. Through the valve, the steam sprayed into the tub 18 may be intermitted and the amount of steam may be adjusted upon occasions.

Here, the steam generated in the sump 20 may be supplied into the tub 18 through the filter flow path and the filter mounting portion, not through the steam nozzle. The sump 20 may be connected to the tub 18 in both directions through the steam flow path and the filter flow path.

Figure 2:
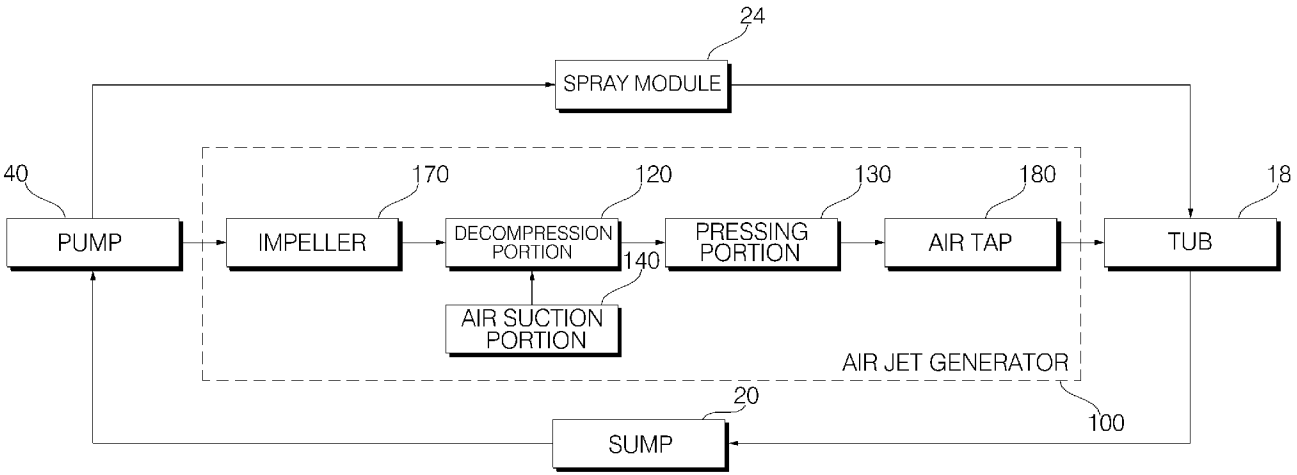
FIG. 2 is a block diagram illustrating a flow of washing water in a dishwasher including an air jet generator according to an embodiment of the present invention.
Figure 3:
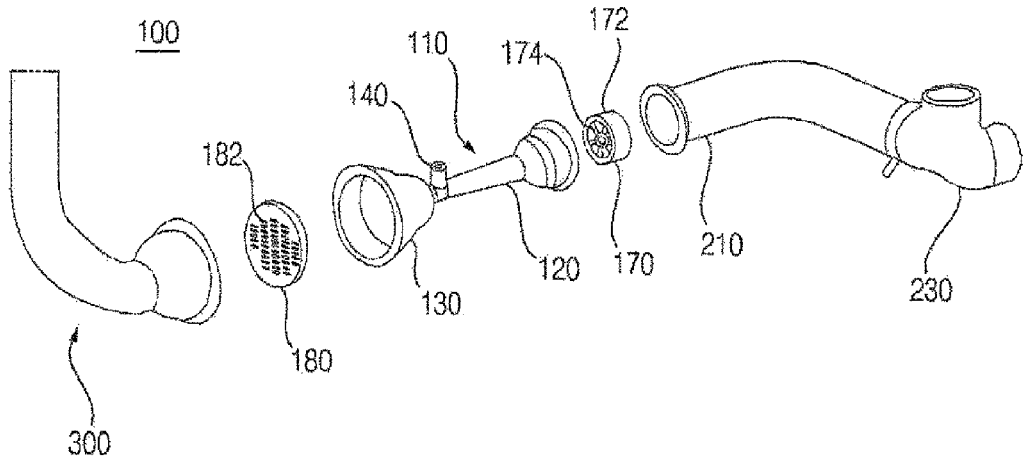
FIG. 3 is an exploded perspective view of an air jet generator according to the present embodiment.
Figure 4:
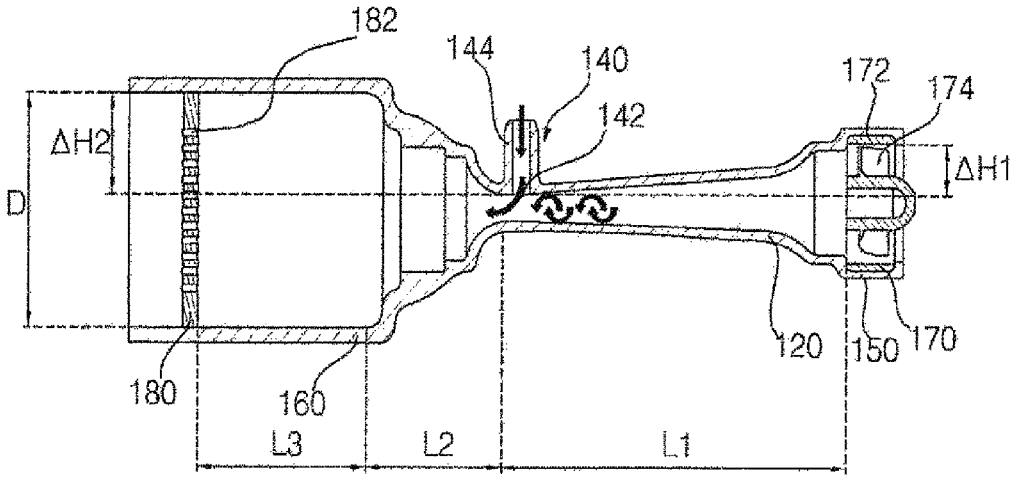
FIG. 4 is a side cross-sectional view for explaining an internal flow path of an air jet generator according to the present embodiment.
Figure 5:
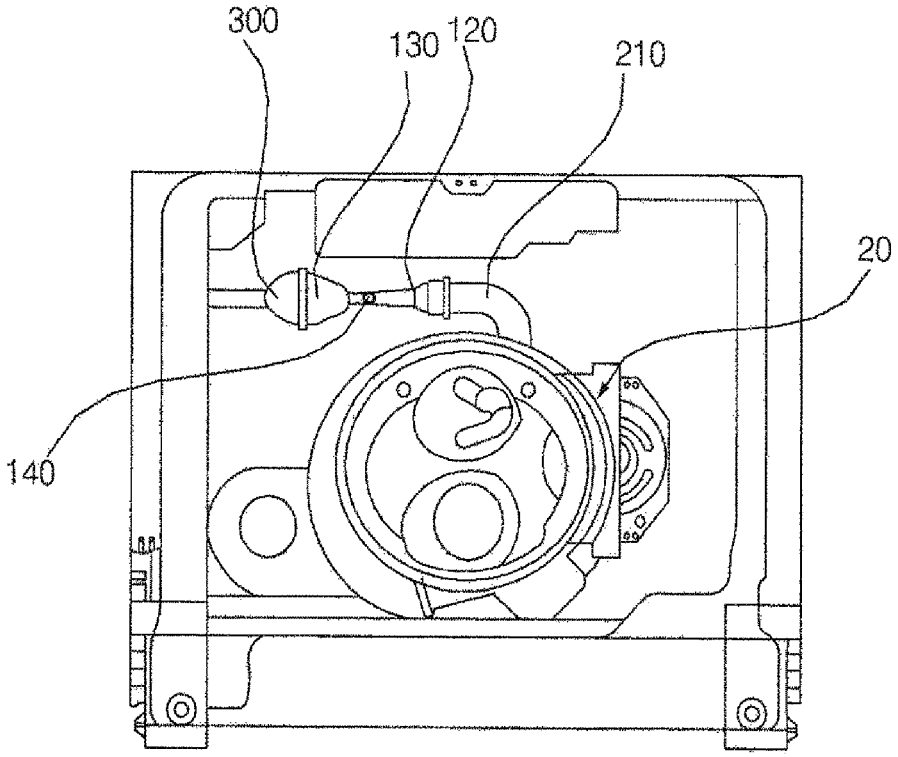
FIG. 5 is a diagram for explaining the disposition of an air jet generator according to the present embodiment.
Figure 6:
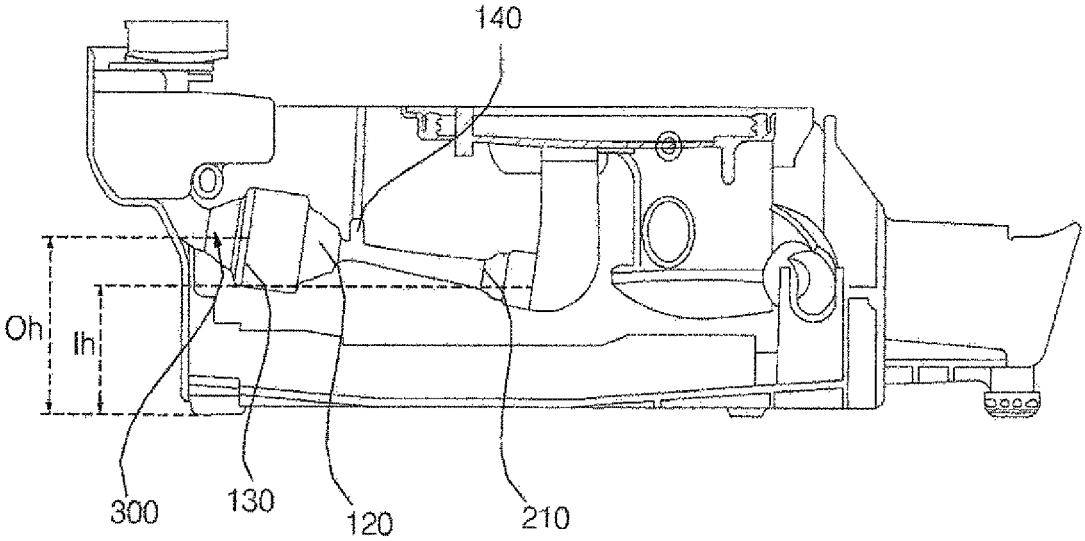
FIG. 6 is a diagram for explaining a side disposition of an air jet generator according to the present embodiment.
Figure 7:
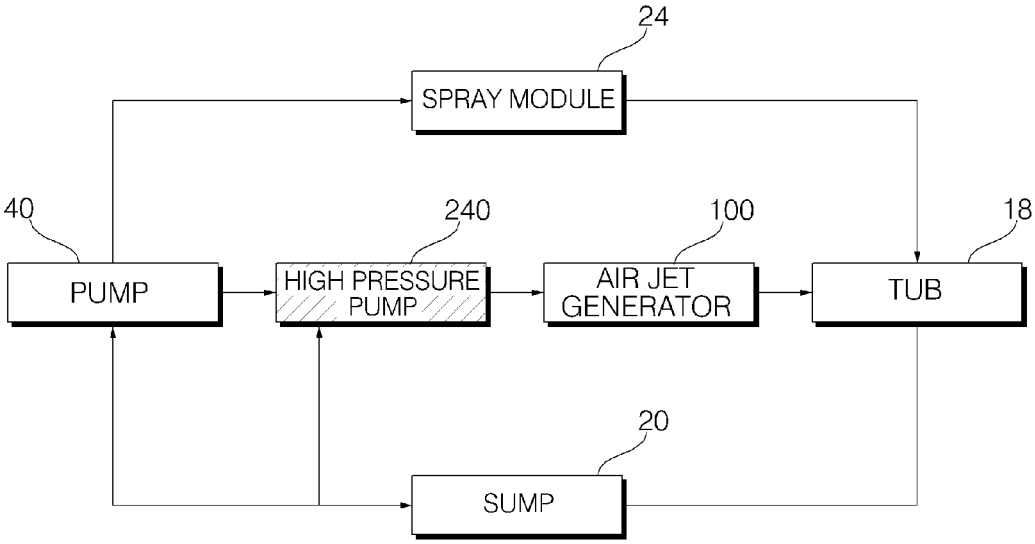
FIG. 7 is a block diagram of a dishwasher including an air jet generator and a high pressure pump according to another embodiment of the present invention.

FIG. 2 is a block diagram illustrating a flow of washing water in a dishwasher including an air jet generator according to an embodiment of the present invention. FIG. 3 is an exploded perspective view of an air jet generator according to the present embodiment. FIG. 4 is a side cross-sectional view according to the present embodiment. FIG. 5 is a diagram for explaining the disposition of an air jet generator according to the present embodiment. FIG. 6 is a diagram for explaining a side disposition of an air jet generator according to the present embodiment. FIG. 7 is a block diagram of a dishwasher including an air jet generator and a high pressure pump according to another embodiment of the present invention.

Referring to FIG. 2, the flow of washing water is described. The washing water stored in the sump 20 of the dishwasher 10 is supplied to the spray module 24 through the pump 40, and flows into the sump 20 again through the tub 18. In the dishwasher 10 according to the present embodiment, a part of the washing water that passed through the pump 40 flows into the air jet generator 100 which generates air bubbles in the washing water.

The air jet generator 100 is supplied with a part of the washing water discharged from the pump 40. The air jet generator 100 generates air bubbles in the washing water by passing the introduced washing water, through an air tap 180 and an air crushing pipe 110 including an impeller 170, an air suction portion 140, a decompression portion 120, and a pressing portion 130. The washing water containing the air bubbles is discharged to tub 18 again and flows into the sump 20. According to the present embodiment, the washing water is discharged to the side surface of the tub 18. Therefore, when the pump 40 is operated due to the operation of the dishwasher 10, air bubbles are generated in the washing water, and the washing water containing the air bubbles is introduced into the sump through the tub and then supplied to the spray module through recirculation.

Referring to FIGS. 3 and 4, the air jet generator 100 according to the present embodiment will be described.

The air jet generator 100 according to the present embodiment includes the impeller 170 for applying centrifugal force to the washing water that flows, the decompression portion 120 for reducing the pressure of the washing water that passed through the impeller, the air suction portion 140 which is opened to allow air to be introduced into the decompression portion, the pressing portion 130 for increasing a pressure to crush the air introduced from the air suction portion, and the air tap 180 having a plurality of holes for crushing the air contained in the washing water passed through the pressing portion.

The decompression portion 120 has a cross-sectional area of the flow path that is decreased in the traveling direction of the washing water. The pressing portion 130 is formed in such a manner that the rate of increase in the cross-section of the flow path per flow path length is larger than the rate of decrease in the cross-section of the flow path per flow path length of the decompression portion. The air suction portion 140 is disposed in a portion where the flow path area of the decompression portion 120 is decreased.

The decompression portion 120 and the pressing portion 130 form a single air crushing pipe 110.

The air jet generator 100 is connected to an inflow pipe 210 for allowing a part of the washing water passed through the pump 40 to flow to the air crushing pipe 110, and is connected to a discharge pipe 220 for discharging the washing water passed through the air crushing pipe 110.

The discharge module 300 according to the present embodiment discharges the washing water introduced from the air jet generator 100 to the side surface 19 of the tub 18. The discharge module 300 may be connected directly to the side surface of the tub 18 or may be disposed in the side surface of the tub 18 to supply the washing water containing air bubbles to the side surface of the tub 18 through the side surface structure forming a tub discharge flow path.

The discharge module 300 includes a main discharge pipe 310 connected to the air jet generator 100.

The inflow pipe 210 is connected to the air crushing pipe 110 and sends part of the washing water discharged from the pump 40 to the air crushing pipe 110. The discharge pipe 220 connects the air crushing pipe 110 and the sump 20 or the tub 18 to flow the washing water discharged from the air crushing pipe 110 to the tub 18.

An inflow end surface 112 of the air crushing pipe 110 and an end surface of the inflow pipe 210 are coupled to each other in a fusing manner at a portion where they are in contact with each other. A discharge end surface 114 of the air crushing pipe 110 and the end surface of the discharge pipe 220 are coupled to each other in a fusing manner at a portion where they are in contact with each other.

Referring to FIG. 4, the impeller 170 is mounted in an impeller mounting portion 150 of the air crushing pipe 110 described below. The impeller 170 is disposed before the decompression portion 120 of the air crushing pipe 110 in the direction in which the washing water flows. Thus, the impeller 170 is not mounted in the impeller mounting portion 150 of the air crushing pipe 110 but may be disposed inside the inflow pipe 210 or between the decompression portion 120 and the inflow pipe 210.

The impeller 170 according to the present embodiment is mounted and fixed to the impeller mounting portion 150. The impeller 170 includes an impeller circumferential portion 172 having an annular outer shape and a vane 174 disposed inside the impeller circumferential portion 172 to apply centrifugal force to the washing water. The impeller circumferential portion 172 abuts against the impeller mounting portion 150 and is fixed.

The washing water passed through the impeller 170 rotates as it passes through the vane 174 to generate a swirling flow. The vane 174 of the impeller 170 applies a centrifugal force to the washing water flowing to the decompression portion 120. The vane 174 of the impeller 170 may be fixed or rotated and applies centrifugal force to the washing water passing through the impeller 170.

The air crushing pipe 110 includes the decompression portion 120 for decompressing the washing water and increasing the speed of the washing water and the pressing portion 130 in which the cross-sectional area of the flow path is drastically increased. The decompression portion 120 is provided with an air suction portion 140 which sucks air from a portion where the washing water is decompressed to form a negative pressure.

The air crushing pipe 110 further includes the impeller mounting portion 150 in which the impeller 170 is mounted and an air tap mounting portion 160 in which the air tap 180 is mounted.

The air crushing pipe 110 is disposed in the order of the impeller mounting portion 150, the decompression portion, the pressing portion, and the air tap mounting portion 160 in the direction in which the washing water flows. The air suction portion 140 is formed at a portion where the flow path cross-sectional area of the decompression portion 120 is reduced. The air suction portion 140 forms a suction port opened upward at a portion where the decompression of the decompression portion 120 is terminated.

The impeller mounting portion 150 is connected to the end of the inflow pipe 210, and the inner circumference of the impeller mounting portion 150 is formed to correspond to the outer circumference of the impeller circumferential portion 172 such that the impeller 170 is mounted and fixed to the impeller mounting portion 150.

The decompression portion 120 is disposed in the next position of the impeller mounting portion 150 of the air crushing pipe 110 in the direction in which the washing water flows. The decompression portion 120 is a part of the air crushing pipe 110 through which the washing water that passed through the impeller 170 flows. In the decompression portion 120, the cross sectional area of the flow path is decreased in the progress direction of the washing water such that the pressure of the washing water flowing through the decompression portion 120 is decreased and the speed is increased.

In the decompression portion 120, the cross section of the flow path is gradually decreased in the progress direction of the washing water.

The decompression portion 120 forms an air suction portion 140 at a portion where the decompression is terminated. The air suction portion 140 is formed at a portion where the cross-section of the flow path of the decompression portion 120 is reduced. The air suction portion 140 forms an air suction port 142 opened toward the upper side of the dishwasher opposite to the ground to prevent the water from flowing toward the air suction portion and being accumulated even if the pump does not operate.

The air suction portion 140 forms an air suction port 142 opened upward from one side of the decompression portion 120. The air suction portion 140 includes an air suction pipe 144 protruding from one side of the decompression portion 120 to form a flow path through which air is sucked therein. The air suction pipe 144 is connected to a connection pipe (not shown) connected to suck the outside air. The connection pipe is connected to the outside of the dishwasher 10 or into the tub 18. The connection pipe may be coupled to the air suction pipe 144 in a fusing manner.

The air suction pipe 144 may be integrally formed with the connection pipe and directly connected to the outside of the dishwasher 10 or to the tub 18.

In the decompression portion 120, the area of the flow path is decreased toward the progress direction of the washing water so that the pressure of the washing water is lowered, and a negative pressure lower than the atmospheric pressure is formed at a portion where the suction port 42 of the air suction portion 140 is formed such that the outside air is sucked in by itself. The air sucked into the air crushing pipe 110 is primarily crushed by the speed and the swirling force of the washing water flowing inside the decompression portion 120. The air suction unit 140 can be connected with an air pump (not shown) so as to inject more air into the air crushing pipe 110.

The washing water containing the primarily crushed air flows to the pressing portion 130.

The pressing portion 130 is disposed in the next part of the decompression portion 120 of the air crushing pipe 110 in the direction in which the washing water flows. The pressing portion 130 receives the washing water that passed through the decompression portion 120.

The pressing portion 130 increases the pressure to such an extent that the air introduced from the air suction portion 140 is crushed. In the pressing portion 130, the cross-sectional area of the flow path is rapidly increased in the direction in which the washing water flows so that the air contained in the washing water can be crushed. The increasing ratio ($\Delta H2/L2$) of the radius of the flow path cross section per flow path length of the pressing portion 130 is larger than the decreasing ratio ($\Delta H1/L1$) of the radius of the flow path cross section per flow path length of the decompression portion.

The flow path cross-sectional area of a discharge end portion of the pressing portion 130 is formed wider than the flow path cross-sectional area of an inflow end portion of the decompression portion 120. The pressing portion 130 expands larger than the flow path cross-section of the inflow pipe 210 so that the air crushing through a pressure difference occurs effectively.

As the cross-sectional area of the flow path rapidly increases, the speed of the washing water decreases, and the pressure rapidly increases. Due to a sudden increase in pressure, the air in the washing water is secondarily crushed.

In the direction in which the washing water flows, a side end surface of the flow path of the pressing portion 130 increases like a curved line of a quadratic function, and then, is bent in a stepped shape and a side end surface of the flow path is widened. Since the cross section of the flow path of the pressing portion 130 is gradually expanded in a narrow section, air crushing in the washing water through the pressure difference effectively proceeds.

The air tap mounting portion 160 is disposed in the next position of the pressing portion 130 of the air crushing pipe 110 in the direction in which the washing water flows. The air tap mounting portion 160 maintains a constant flow path extended from the pressing portion 130, and the air tap 180 is mounted inside the air tap mounting portion 160.

The air tap 180 is mounted in the air tap mounting portion 160 of the air crushing pipe 110. The air tap 180 is fixed to the air tap mounting portion 160. The air tap 180 is disposed at a position spaced apart from the pressing portion 130 by a certain distance.

The air tap 180 has a disk shape, and is provided with a plurality of holes 182 penetrating the inside thereof. The washing water passed through the pressing portion 130 passes through the air tap. The air in the washing water is thirdly crushed while passing through the plurality of holes 182 formed in the air tap 180.

The holes 182 formed in the air tab 180 are disposed closely to the disk-shaped air tab 180 at regular intervals. The air tap 180 may be provided with a hollowed type hole or a slot type hole elongated in the left and right direction. In addition, it may be a cross slot type hole in which an elliptical shape elongated in the vertical direction and an elliptical shape elongated in the left and right direction are combined.

In the hole 182 formed in the air tap 180, as the contact area with the air bubble increases, the shearing force acting on the air bubble increases to increase the amount of generated air bubbles. Thus, the slot type hole is preferable to the hollowed type hole. However, when the size of the hole is excessively increased as in the case of the cross slot type, the air tap may have a reliability problem. Thus, it is preferable that the air tap 180 has a slot type hole.

When the hole of the air tap 180 having the slot type hole is elongated in the left and right direction, and the ratio of the vertical height to the horizontal length of the slot type hole is 1: 4 to 6, the amount of generated air bubbles increases, and it is also suitable for the reliability of the air tap. Thus, it is preferable that the ratio of the height to the horizontal length of the slot type hole is 1: 4 to 6.

As the washing water passes through the pressing portion 130, the sucked air is secondarily crushed. The air tap 180 is spaced apart from the pressing portion 130 at a predetermined interval. When the air tab 180 is spaced from the pressing portion 130 at regular intervals, the sucked air is sufficiently secondarily crushed through the pressing portion 130, and then, passes through the air tap 180 again, thereby increasing the amount of generated air bubbles. Therefore, it is preferable that the distance L3 of the air tap 180 spaced from the pressing portion 130 maintains a distance of the diameter size D or more of the cross section of the air tap so as to maximize the amount of generated air bubbles.

As the thickness of the air tap 180 becomes thinner, the possibility of clogging due to foreign substances is lowered, and there is an advantage that mass production is easy. Since the effect of crushing the air is not significantly different depending on the thickness of the air tap 180, it is preferable that the thickness of the air tab 180 is manufactured with a thickness ranging from 2 to 5 mm.

The discharge pipe 220 has a shape in which a side end surface of the flow path is reduced at a portion where the washing water is introduced. In the discharge end of the air crushing pipe 110, the flow path is expanded for the air crushing, and the discharge pipe 220 has a shape in which a side end surface of the flow path is reduced at a portion where the washing water is introduced, in order to reduce the size of the flow path volume of the discharge pipe 220 connected to the tub 18 or the sump 20.

Referring to FIG. 5, the air jet generator 100 is disposed in the side surface of the lower portion of the dishwasher 10. The air jet generator 100 sucks air, is disposed in the lower portion of the dishwasher 10 in consideration of vibration and noise generated in the process of forming the air bubbles, and is disposed in the side surface close to the pump 40 to minimize the flow path volume.

Referring to FIG. 6, the height (Oh) of the center of the discharge end of the pressing portion 130 from the lower end of the dishwasher 10 is disposed higher than the height (Ih) of the center of the inflow end of the decompression portion 130 from the lower end of the dishwasher 10. Since the center of the discharge end of the air crushing pipe 110 is disposed higher than the center of the inflow end, even if the pump stops operating, residual water remaining in the air jet generator 100 is discharged to the inflow pipe 210, so that the water is not accumulated inside the generator 100.

Referring to FIG. 7, in the dishwasher 10 according to another embodiment of the present invention, the washing water stored in the sump 20 is supplied to the spray module 24 through the pump 40, and flows into the sump 20 through the tub 18.

The air jet generator 100 may be provided with washing water through a separate high pressure pump 240 without being connected to the branch pipe 230 branched from the pump 40. Accordingly, the washing water stored in the sump 20 flows to the spray module 24 through the pump 40 or flows to the air jet generator 100 through the high pressure pump 240 to form an air bubble.

According to another embodiment of the present invention, when the dishwasher 10 includes a separate high pressure pump 240, the pressure of the washing water flowing into the air crushing pipe 110 is strongly formed, which is advantageous in forming air bubbles.

Figure 8:
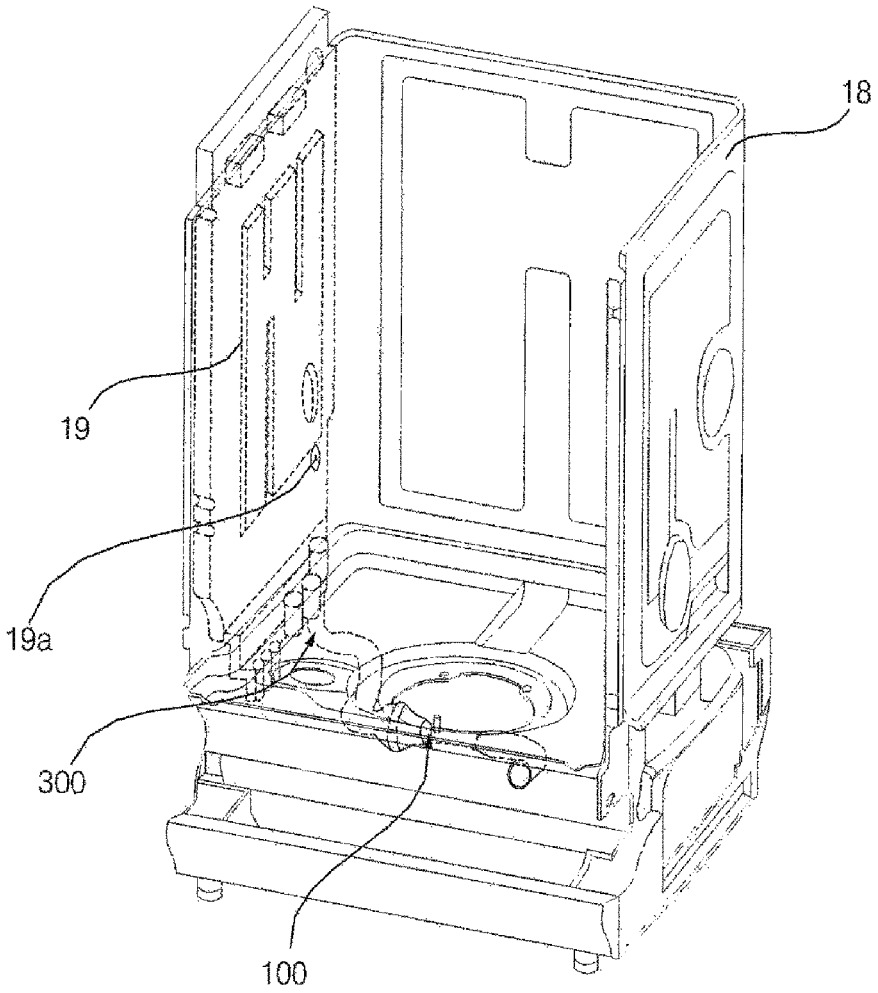
FIG. 8 is a diagram illustrating a structure in which a discharge module is connected to a side surface of a tub according to an embodiment of the present invention.
Figure 9:
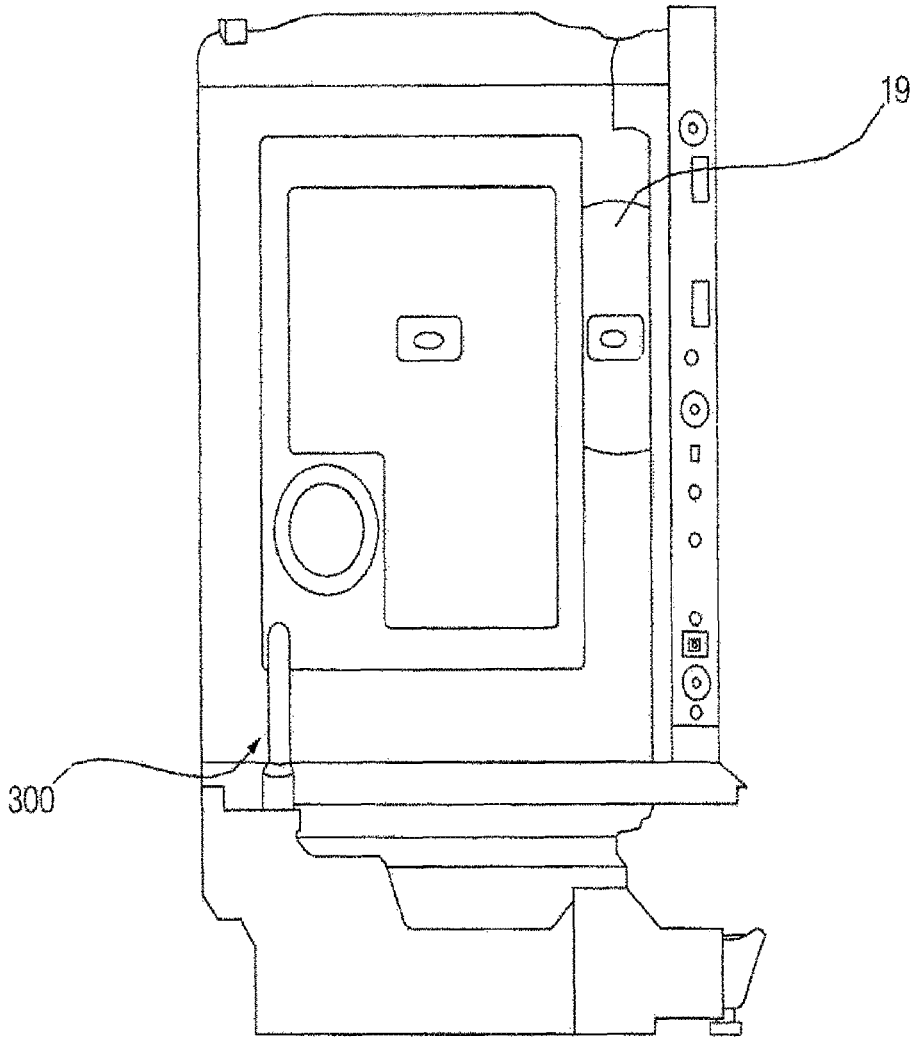
FIG. 9 is a diagram illustrating a discharge module directly connected to a tub according to an embodiment of the present invention.
Figure 10:
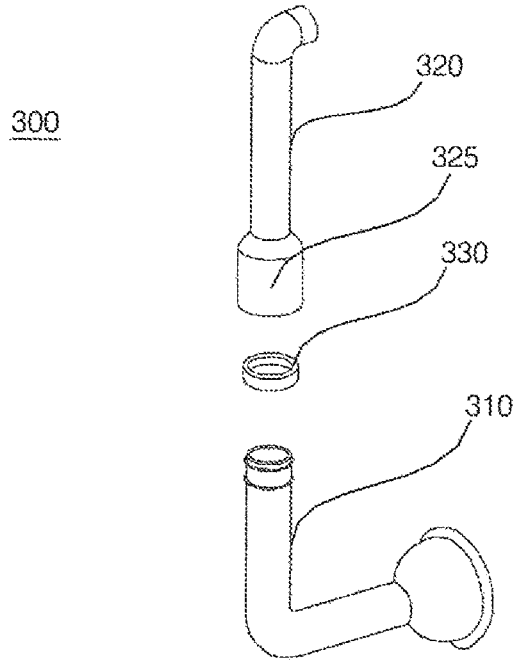
FIG. 10 is an exploded view of a configuration of a discharge module used in FIG. 9 according to an embodiment.
Figure 11:
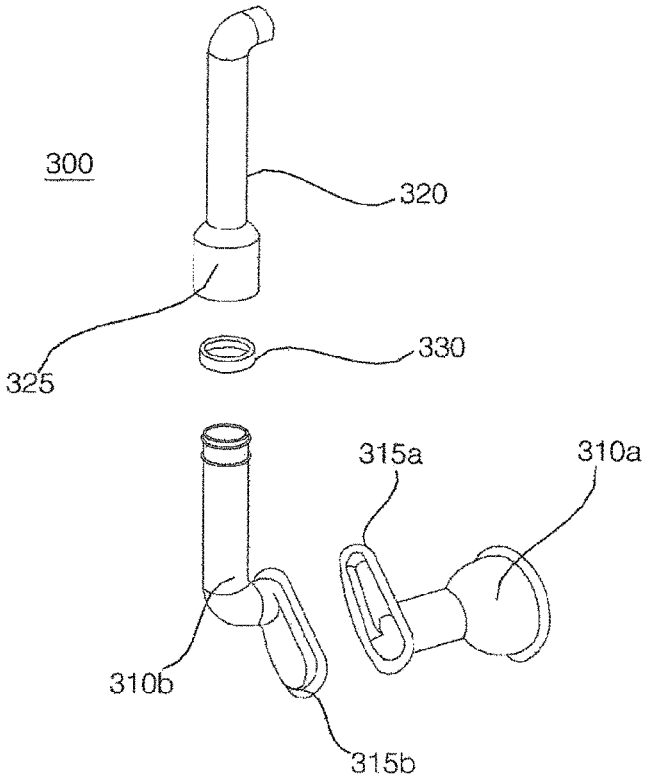
FIG. 11 is an exploded view of a configuration of a discharge module used in FIG. 9 according to another embodiment.
Figure 12:
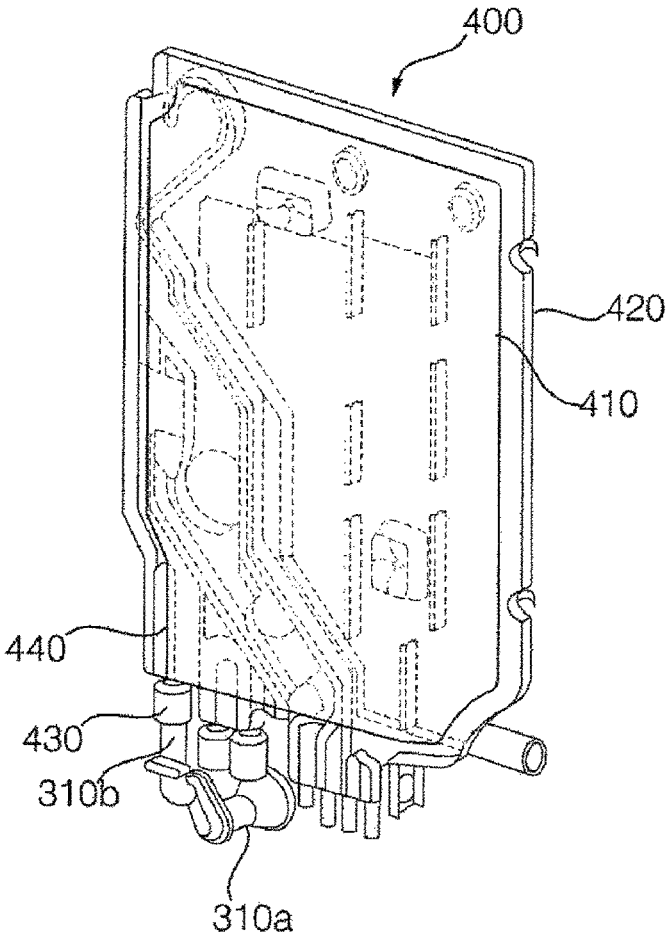
FIG. 12 is a diagram illustrating a side surface structure for forming a tub discharge path and a discharge module connected to the side surface structure according to another embodiment of the present invention.
Figure 13A:
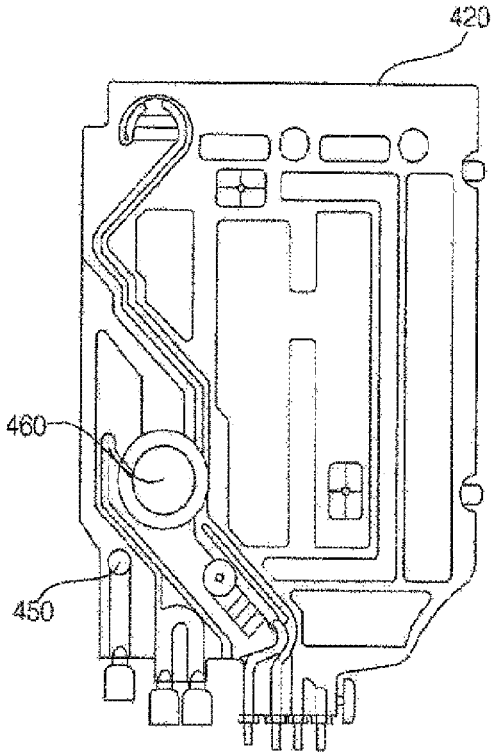
FIG. 13A is a diagram illustrating a frame which is a configuration of the side surface structure used in FIG. 12.
Figure 13B:
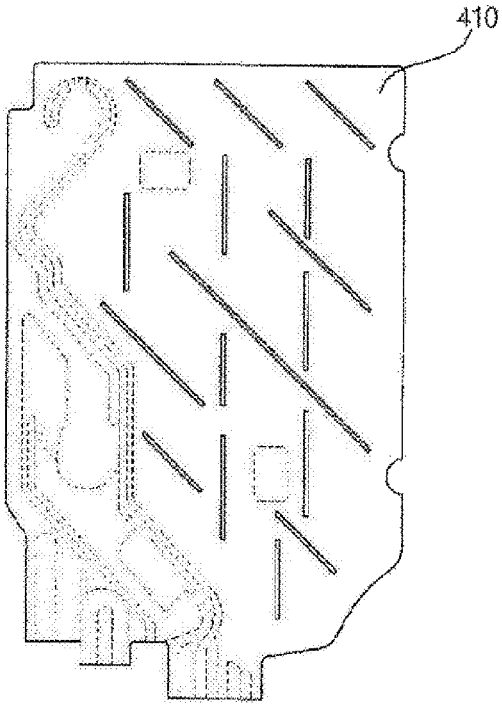
FIG. 13B is a diagram illustrating a guide cover which is a configuration of the side surface structure used in FIG. 12.
Figure 14:
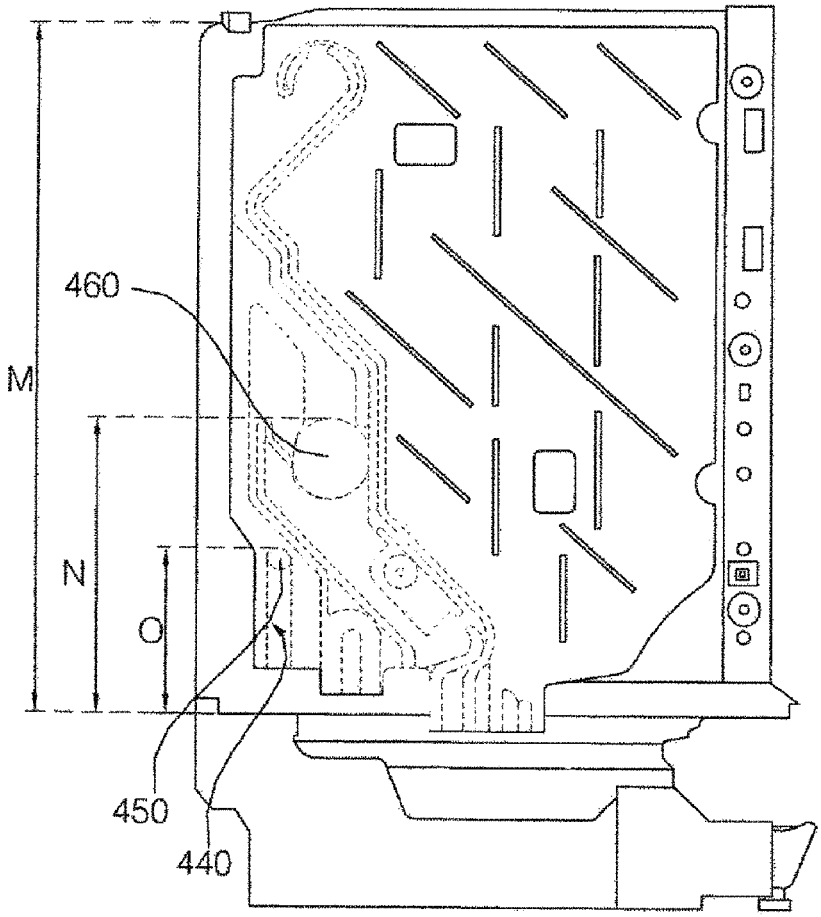
FIG. 14 is a diagram for explaining a height of a discharge port according to an embodiment of the present invention.
Figure 15:
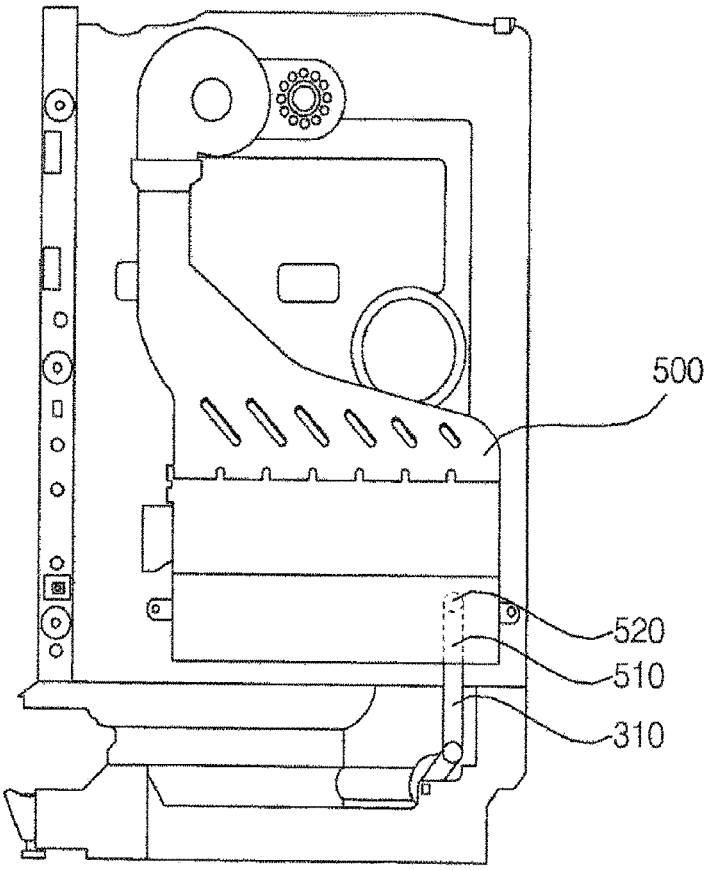
FIG. 15 is a diagram illustrating a side surface structure and a discharge module connected to the side surface structure according to another embodiment of the present invention.
Figure 16:
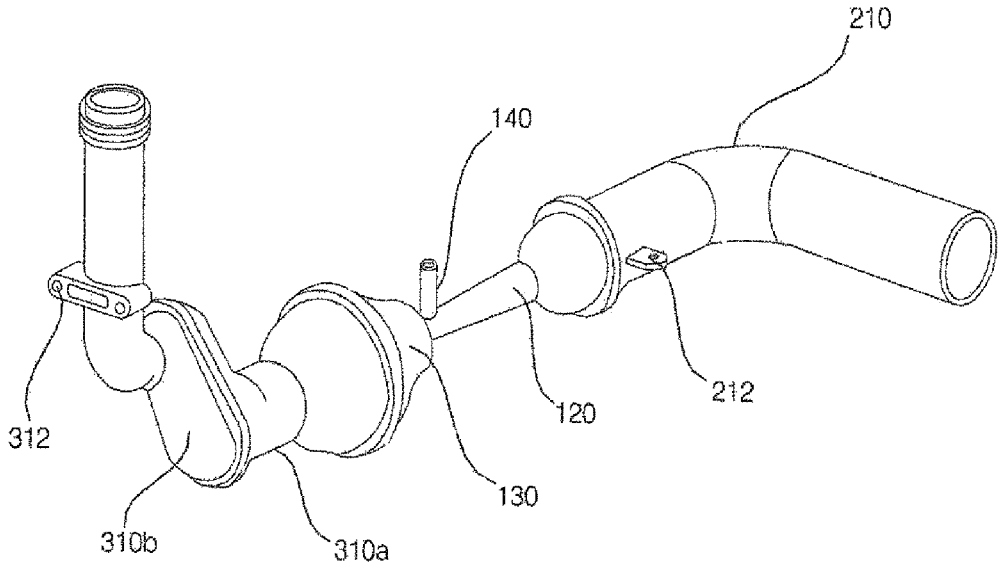
FIG. 16 is a diagram illustrating an inflow pipe and a discharge module that include a fixing portion according to an embodiment of the present invention.
Figure 17:
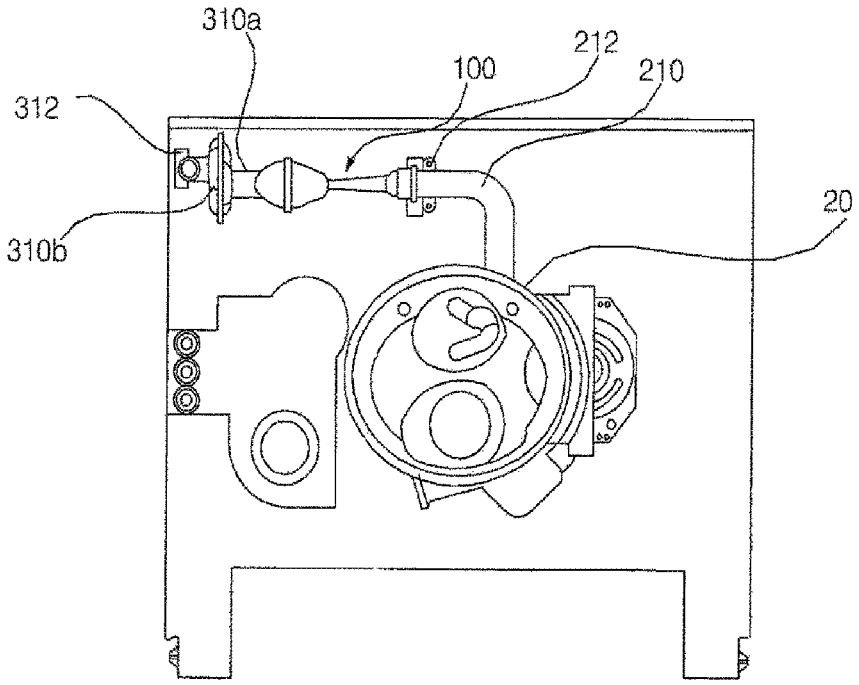
FIG. 17 is a diagram illustrating a state in which the inflow pipe and the discharge module of FIG. 16 are disposed in a dishwasher.

FIG. 8 is a diagram illustrating a structure in which a discharge module is connected to a side surface of a tub according to an embodiment of the present invention. FIG. 9 is a diagram illustrating a discharge module directly connected to a tub according to an embodiment of the present invention. FIG. 10 is an exploded view of a configuration of a discharge module used in FIG. 9 according to an embodiment. FIG. 11 is an exploded view of a configuration of a discharge module used in FIG. 9 according to another embodiment. FIG. 12 is a diagram illustrating a side surface structure for forming a tub discharge path and a discharge module connected to the side surface structure according to another embodiment of the present invention. FIG. 13 is a diagram illustrating a frame and a guide cover which are a configuration of the side surface structure used in FIG. 12. FIG. 14 is a diagram for explaining a height of a discharge port according to an embodiment of the present invention. FIG. 15 is a diagram illustrating a side surface structure and a discharge module connected to the side surface structure according to another embodiment of the present invention. FIG. 16 is a diagram illustrating an inflow pipe and a discharge module that include a fixing portion according to an embodiment of the present invention. FIG. 17 is a diagram illustrating a state in which the inflow pipe and the discharge module of FIG. 16 are disposed in a dishwasher.

Referring to FIG. 8, the discharge module 300 according to the present embodiment discharges the washing water introduced from the air jet generator 100 to the tub 18. The discharge module 300 connects the air jet generator 100 and the tub 18, and, specifically, to the side surface 19 of the tub 18. Since the washing water containing the air bubbles flows to the bottom of the tub along the tub side surface 19, the dirt on the bottom of the tub is removed due to the air bubbles A side surface hole 19*a* is formed in the side surface 19 of the tub 18, and the washing water discharged from the air jet generator 100 is discharged into the tub through the side surface hole 19*a* formed on the side surface of the tub 18 through the discharge module 300.

The discharge module 300 is directly connected to the side surface of the tub 18 or disposed in the side surface of the tub 18 and discharges the washing water from the side surface of the tub 18 through the side surface structure 400, 500 forming the tub discharge flow path 440 and 510. The side surface structure 400, 500 may be a water jacket for supplying washing water to the sump 20, or a drying duct for drying the dishes.

First, referring to FIGS. 9 to 11, a structure in which the discharge module 300 is directly connected to the side surface of the tub will be described.

Referring to FIG. 9, the discharge module 300 directly connects the air jet generator 100 and the tub 18. The discharge module 300 is connected to the side surface hole 19*a* formed in the side surface of the tub. In one side of the side surface 19 of the tub 18, the side surface hole 19*a* for discharging the washing water flowing in the discharge module 300 into the tub 18 is formed.

The discharge module 300 flows the washing water discharged from the air jet generator 100 into the tub 18 through the side surface hole 19*a* of the tub 18. The washing water containing the air bubbles is discharged into the tub through the discharge module 300 and the side surface hole 19*a* and flows into the sump 20.

Referring to FIG. 10, the discharge module 300 according to the present embodiment includes a main discharge pipe 310 to which the washing water discharged from the air jet generator is introduced, a tub discharge pipe 320 which connects the main discharge pipe 310 and the tub 18, and a sealer 330 which seals a space between the main discharge pipe 310 and the tub discharge pipe 320.

The main discharge pipe 310 is connected to the discharge end of the air jet generator 100. In the main discharge pipe 310, the cross section of the flow path is partially reduced in the flow direction of the washing water at a portion adjacent to the air jet generator 100. Since maintaining the extended sectional area of the flow path in the pressing portion 130 is inefficient in utilizing a lower space, the discharge pipe 310 has a shape in which the side end surface of the flow path is reduced, at a portion where the washing water is introduced.

The inflow end of the main discharge pipe 310 and the discharge end of the air jet generator 100 are coupled in a fusing manner.

The main discharge pipe 310 is bent at some sections to be connected to the tub discharge pipe 320. One side of the main discharge pipe 310 is connected to the air jet generator 100, and the other side is connected to the tub discharge pipe 320.

A part of the outer circumference of the main discharge pipe 310 is fitted into a part of the inner circumference of tub discharge pipe 320. The sealer 330 is disposed between the main discharge pipe 310 and the tub discharge pipe 320. The sealer 330 is disposed between the main discharge pipe 310 and the tub discharge pipe 320 and seals a portion where the main discharge pipe 310 and the tub discharge pipe 320 are coupled.

The tub discharge pipe 320 connects the main discharge pipe 310 and the tub 18, and sends the washing water into the tub 18. The tub discharge pipe 320 extends along the side surface 19 of the tub 18, and is bent at a portion where the side surface hole 19*a* is formed and connected to the side surface hole 19*a*.

The tub discharge pipe 320 forms a coupling portion 325 at a portion where the tub discharge pipe 320 is coupled with the main discharge pipe 310. The coupling portion 325 is formed to be wider than the flow path cross-section of the tub discharge pipe 320 and has a size for surrounding the outer circumference of the main discharge pipe 310. The outer circumference of the main discharge pipe 310 is fitted to the inner circumference of the coupling portion 325. The sealer 330 is disposed between the inner circumference of the coupling portion 325 and the outer circumference of the main discharge pipe 310.

Referring to FIG. 11, the main discharge pipe 310 may be configured of two pipes including a first main discharge pipe 310*a* and a second main discharge pipe 310*b*. The first main discharge pipe 310*a* is a pipe connected to the air jet generator 100. In a portion adjacent to the air jet generator 100, the flow path cross-section is partially reduced in the flow direction of the washing water. The first main discharge pipe 310*a* is disposed in the lower side of the bottom surface of the tub 18 to be parallel to the bottom surface of the tub, or partially inclined. The first main discharge pipe 310*a* forms a first flow path change coupling portion 315*a* where the flow path cross-section is vertically extended to one side at a portion where the first main discharge pipe 310*a* is coupled with the second main discharge pipe 310*b*.

The second main discharge pipe 310*b* connects the tub discharge pipe 320 and the first main discharge pipe 310*a*. The second main discharge pipe 310*b* may include a partly bent section, but is disposed in parallel to the side surface of the tub as a whole. The second main discharge pipe 310*b* is connected to the tub discharge pipe 320. The second main discharge pipe 310*b* forms a second flow path change coupling portion 315*b* where the flow path cross-section is vertically extended to one side at a portion where the second main discharge pipe 310*b* is coupled with the first main discharge pipe 310*a*.

The first flow path change coupling portion 315*a* of the first main discharge pipe 310*a* and the second flow path change coupling portion 315*b* of the second main discharge pipe 310*b* are coupled to each other to form a vertical or curved flow path in the flow path of the first main discharge pipe 310*a*.

The flow direction of the washing water is changed at a portion where the first main discharge pipe 310*a* and the second main discharge pipe 310*b* are coupled to each other. The first main discharge pipe 310*a* and the second main discharge pipe 310*b* are coupled by a fusing method at a portion where both pipes are abutted. The first flow path change coupling portion 315*a* and the second flow path change coupling portion 315*b* are coupled by a fusing method.

Hereinafter, a discharge module connected to the side surface structure will be described with reference to FIGS. 12 to 15.

Referring to FIGS. 12 and 13, the dishwasher according to the present embodiment may have the side surface structure 400 disposed outside the side surface 19 of the tub 18. The side surface structure 400 according to the present embodiment may be a water jacket for supplying washing water.

A tub discharge flow path 440 is formed inside the side surface structure 400, and a discharge port 450 for discharging the washing water flowing to the tub discharge flow path 440 into the tub is formed in one side of the tub discharge flow path 440. In addition, the side surface hole 19*a* is formed in the tub 18 at a position corresponding to the discharge port 450.

Referring to FIG. 13, the side surface structure 400 includes a frame 420 disposed to abut on the side surface 19 of the tub 18 and a guide cover 410 coupled to the frame in a shape corresponding to the frame 420. The frame 420 and the guide cover 410 form both side surfaces of the side surface structure 400, and form the tub discharge flow path 440 therein.

The frame 420 is provided with the discharge port 450 formed at a position corresponding to the side surface hole 19*a* of the tub 18. The frame 420 of the water jacket may further include a tub hole 460 communicating with a water supply flow path inside the water jacket. The washing water introduced from the main discharge pipe 310 flows along the tub discharge flow path 440 and is discharged to the tub 18 through the discharge port 450.

The tub discharge flow path 440 is connected to the main discharge pipe 310 at a lower portion. Inside the guide cover and the frame, the tub discharge flow path 440 through which the washing water introduced from the main discharge pipe 310 flows is formed.

A lower portion of the tub discharge flow path 440 includes a generator connection port 430 for connecting with the main discharge pipe 310. The outer circumference of the main discharge pipe 310 is fitted to the inner circumference of the lower portion of the generator connection port 430. A sealer for sealing may be disposed between the generator connection port 430 and the main discharge pipe 310.

The main discharge pipe 310 may be integrally formed or formed of the first main discharge pipe 310*a* and the second main discharge pipe 310*b*.

The height O of the discharge port 450 from the bottom surface of the tub 18 is equal to or less than half of the height M of the tub 18. Therefore, the height of the side surface hole 19*a* is also formed in a portion of being equal to or less than half of the tub height. The height O of the discharge port 450 from the bottom surface of the tub 18 is formed to be lower than the height N of the tub hole 460 from the bottom surface of the tub 18.

The height O of the discharge port 450 from the bottom surface of the tub 18 is formed to be equal to or less than half of the height M of the tub 18 so as to reduce the amount of the washing water that flows unnecessarily by reducing the length of the tub discharge flow path 440.

Referring to FIG. 15, the side surface structure 500 disposed outside the side surface 19 of the tub 18 may be a drying duct for discharging the air of washing tub. Similarly, in the case of the drying duct, the tub discharge flow path 510 and the discharge port 520 are formed inside the drying duct, and the tub discharge flow path 510 is connected to the main discharge pipe 310 at the lower portion, so that the washing water containing air bubbles introduced from the air jet generator 100 is discharged into the tub 18.

Hereinafter, a fixing portion formed in the inflow pipe and the discharge module will be described with reference to FIGS. 16 to 17.

Since any vibrations occur in the process of sucking and crushing the air, the air jet generator 100 includes a fixing portion 212, 312 for fixing the inflow pipe 210 and the discharge module 300 to the cabinet of the dishwasher.

The inflow pipe 210 includes an inflow pipe fixing portion 212 for fixing the inflow pipe 210. The inflow pipe fixing portion 212 according to the present embodiment is fixed to the lower portion of the cabinet 14. The discharge module 300 includes a discharge pipe fixing portion 312 for fixing the discharge module 300. The discharge pipe fixing portion 312 according to the present embodiment is fixed to the side surface of the cabinet 14. The discharge pipe fixing portion 312 is formed in the main discharge pipe 310 disposed adjacent to the air jet generator 100. When the main discharge pipe 310 is divided into the first main discharge pipe 310*a* and the second main discharge pipe, it is preferable that the discharge pipe fixing portion 312 is formed in the second main discharge pipe 310*b* in that it is fixed at the side surface of the cabinet.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

DESCRIPTION OF NUMERAL

| | | | |
|---|---|---|---|
| 10: | dishwasher | 18: | tub |
| 19: | side surface | 20: | sump |
| 40: | pump | 100: | air jet generator |
| 110: | air crushing pipe | 120: | decompression portion |
| 130: | pressing portion | 140: | air suction portion |
| 170: | impeller | 180: | air tap |
| 210: | inflow pipe | 300: | discharge module |
| 310: | main discharge pipe | 320: | tub discharge pipe |
| 330: | sealer | 400, 500: | side surface structure |
| 440, 510: | tub discharge flow path | | |

The invention claimed is:

1. A dishwasher comprising:

a tub that defines a dish washing space therein;

a sump configured to store washing water supplied into the tub;

a spray module configured to spray washing water to the dish washing space;

a pump configured to supply the washing water stored in the sump to the spray module;

an air jet generator configured to receive, through a flow path branched from the pump, a part of the washing water supplied from the pump to the spray module, and to generate an air bubble to supply the washing water including the air bubble into the tub; and a discharge module configured to receive the washing water including the air bubble from the air jet generator and to discharge the washing water including the air bubble to a side surface of the tub.

2. The dishwasher of claim 1, further comprising a branch pipe that connects the pump to the air jet generator and to the spray module, wherein the air jet generator has a first end directly connected to the branch pipe, and a second end directly connected to the discharge module.

3. The dishwasher of claim 1, further comprising:

a nozzle flow path switching portion configured to supply another portion of the washing water discharged from the pump to a plurality of spray nozzles of the spray module; and a branch pipe that is directly connected to the pump, the nozzle flow path switching portion, and the air jet generator, the branch pipe being configured to divide the washing water from the pump and to supply a first portion of the washing water to the air jet generator and a second portion of the washing water to the nozzle flow path switching portion.

4. The dishwasher of claim 3, wherein the air jet generator has a first end directly connected to the branch pipe, and a second end connected to the tub through the discharge module.

5. A dishwasher comprising:

a tub that defines a dish washing space therein;

a sump configured to store washing water supplied into the tub;

a spray module configured to spray washing water to the dish washing space;

a pump configured to supply the washing water stored in the sump to the spray module;

an air jet generator configured to receive, through a flow path branched from the pump, a part of the washing water supplied from the pump to the spray module, and to generate an air bubble to supply the washing water including the air bubble into the tub; and a discharge module configured to receive the washing water including the air bubble from the air jet generator and to discharge the washing water including the air bubble to a side surface of the tub, wherein the air jet generator comprises:

an impeller configured to rotate, a decompression portion configured to, based on rotation of the impeller, receive the washing water from the impeller and to decrease a pressure of the washing water an air suction portion configured to supply air into the decompression portion, a pressing portion configured to increase the pressure of the washing water to crush the air introduced from the air suction portion, and an air tap that defines a plurality of holes configured to receive the washing water from the pressing portion and to crush the air in washing water.

6. The dishwasher of claim 5, wherein the tub defines a side surface hole configured to discharge the washing water from the discharge module into the tub.

7. The dishwasher of claim 6, wherein the side surface hole is defined at a height equal to or less than half a full height of the tub.

8. The dishwasher of claim 5, wherein the discharge module comprises:

a main discharge pipe configured to receive the washing water discharged from the air jet generator;

a tub discharge pipe connected to the main discharge pipe and connected to the tub; and a sealer that cover a space between the main discharge pipe and the tub discharge pipe.

9. The dishwasher of claim 8, wherein the main discharge pipe comprises:

a first main discharge pipe connected to the air jet generator; and a second main discharge pipe that connects the first main discharge pipe to the tub discharge pipe, and wherein the first main discharge pipe and the second main discharge pipe are coupled by a fusion method.

10. The dishwasher of claim 9, wherein the first main discharge pipe defines a first flow path change coupling portion where a flow path cross-section is vertically extended to one side at a portion where the first main discharge pipe is coupled with the second main discharge pipe, wherein the second main discharge pipe defines a second flow path change coupling portion where a flow path cross-section is vertically extended to one side at a portion where the second main discharge pipe is coupled with the first main discharge pipe, and wherein the first flow path change coupling portion is coupled with the second flow path change coupling portion and defines a bent flow path in a flow path of the first main discharge pipe.

11. The dishwasher of claim 5, further comprising a side surface structure disposed outside the side surface of the tub, wherein the side surface structure comprises:

a tub discharge flow path connected to the discharge module and configured to carry the washing water; and a discharge port configured to discharge the washing water from the tub discharge flow path into the tub.

12. The dishwasher of claim 11, further comprising a generator connection port disposed at a lower end of the tub discharge flow path and connected to the discharge module.

13. The dishwasher of claim 11, wherein the discharge module comprises a main discharge pipe that connects the air jet generator to the tub discharge flow path.

14. The dishwasher of claim 13, wherein the main discharge pipe comprises:

a first main discharge pipe connected to the air jet generator; and a second main discharge pipe that connects the first main discharge pipe to the tub discharge flow path, wherein the first main discharge pipe and the second main discharge pipe are coupled by a fusion method.

15. The dishwasher of claim 11, wherein the discharge port is defined at a height equal to or less than half a full height of the tub.

16. The dishwasher of claim 8, further comprising a cabinet that defines an external shape of dishwasher, wherein the main discharge pipe comprises a discharge pipe fixing portion that fixes the discharge module to the cabinet.

17. The dishwasher of claim 13, further comprising a cabinet that defines an external shape of dishwasher, wherein the main discharge pipe comprises a discharge pipe fixing portion that fixes the discharge module to the cabinet.

18. The dishwasher of claim 5, wherein the impeller, the decompression portion, the pressing portion, and the air tap are arranged along a first direction, and wherein a rotation axis of the impeller extends in the first direction.

19. The dishwasher of claim 18, wherein the impeller comprises a circumferential surface and a vane that are arranged about the rotation axis of the impeller.

* * * * *